United States Patent [19]

Koppe

[11] 4,375,215

[45] Mar. 1, 1983

[54] STOVE FOR BURNING SOLID FUEL

[76] Inventor: Erwin Koppe, Kirchenthumbacher Strasse 38, 8489 Eschenbach, Opf., Fed. Rep. of Germany

[21] Appl. No.: 228,523

[22] Filed: Jan. 26, 1981

[30] Foreign Application Priority Data

Feb. 1, 1980 [DE] Fed. Rep. of Germany ... 8002645[U]

[51] Int. Cl.[3] ..... F23M 7/00

[52] U.S. Cl. ..... 126/200; 126/66; 126/67

[58] Field of Search ..... 126/99 P, 200, 193, 126/61, 66, 67, 81

[56] References Cited

U.S. PATENT DOCUMENTS 2,948,276 8/1960 Harding ..... 126/67

4,136,662 1/1979 Willson ..... 126/200

*Primary Examiner*—James C. Yeung

*Assistant Examiner*—G Anderson

*Attorney, Agent, or Firm*—Jordan and Hamburg

[57] ABSTRACT

A stove for burning solid fuels such as wood, briquettes, peat and the like includes a stove structure having a front and rear and two side walls. The front and rear walls have a width greater than the width of the two sidewalls, and one of the two sidewalls is provided with an access fire door for feeding the solid fuel into the side of the stove.

2 Claims, 2 Drawing Figures

STOVE FOR BURNING SOLID FUEL

BACKGROUND OF THE INVENTION

This invention relates to a stove, particularly a heating stove for the combustion of solid fuels, such as, for example wood, briquettes, or peat.

Heretofore, stoves for combustion of solid fuels were basically fed from the front, in other words the fire door for feeding the fuel was located at the broad front side of the stove. When burning wood this arrangement has the disadvantage that only logs or pieces may be introduced whose length corresponds to the depth of the stove.

In order to overcome this restriction and in order to be capable to use large pieces, particularly root stocks, without any difficulty and without being forced to break them up which is particularly very difficult with root stocks, the present invention provides for the arrangement of the fire door in one of the lateral narrow sides of the stove.

The location of the fire door at a narrow side, according to the present invention, makes it possible to feed much longer logs so that there is less need of cutting the wood. Furthermore, the lateral arrangement of the fire door allows the disposition of an extra large fire door, which would not be possible for a frontal arrangement, because in the latter case the usual observation window would be obstructed. An extra large feed door has the additional advantage that wood need not be cut in its cross section but may be normally pushed in.

The arrangement of the fire door in one of the lateral narrow sides of the stove also makes it possible to provide an extra large observation window in the front, thus affording excellent observation of the combustion process, so that a stove of the invention looks effectively almost like an open fireplace. The fireplace effect is caused by the fact that the panoramic window does not restrict the view but rather provides a clear recognition not only of the burning wood but also of high blazing flames.

In addition it also lies within the scope of the present invention to surround the stove with a cladding structure, which is either wholly or partly filled with decorative tiles. In such a case the lateral wall of this cladding structure which faces the fire door is constructed as a hinged or swivel door.

This side wall provided with the hinged door is preferably provided in its upper area with an air exit lattice and the upper covering of the cladding structure is preferably formed as a cover lattice.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantage thereof will be best understood from the following description of specific embodiments when read in connection with the accompanying drawings.

DESCRIPTION OF THE PREFERRED EMBODIMENTS

Figure 1:
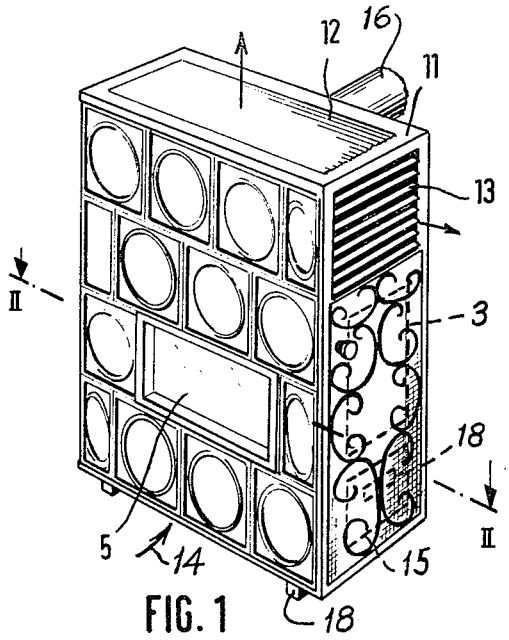
FIG. 1 is a view in perspective of a stove according to one embodiment of the invention.
Figure 2:
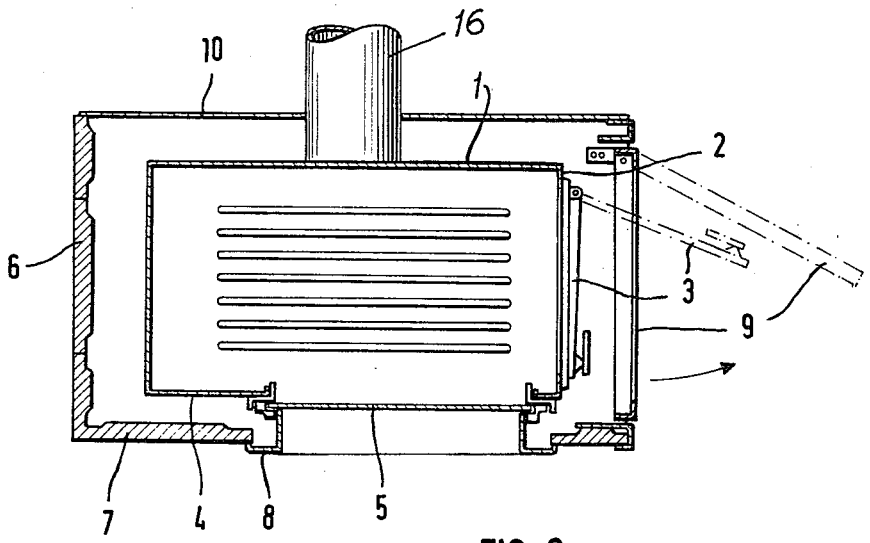
FIG. 2 is an enlarged sectional taken along the line II—II in FIG. 1.

Referring to the drawings, FIGS. 1 and 2 show a stove 1 according to one embodiment of the invention. The stove 1 is provided on one side lateral wall 2 with an extra large fire door 3 so that it may be fed with very large pieces of wood of large cross sections or other large fuel pieces. In the front wall 4 there is disposed a large panoramic window 5 which is of a very large size due to the lack of a fire door which heretofore was usually also arranged in the front wall 4.

The stove 1 is surrounded by a cladding structure whose sidewall 6 and whose front wall 7 are provided with decorative tiles. The front wall 7 is provided with a cutout corresponding to the panoramic window 5 and side wall 6 is provided with a frame 8. The sidewall 9 facing towards the fire door 3 is formed as a hinged or swivel door so that access to the fire door 3 proper is not at all hindered. The rear wall 10 of the stove cladding is a metal plate consisting, for example of galvanized sheet metal. The upper cover consists of a terminal frame 11 with a profiled cover lattice 12.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

Air can enter the space between the stove 1 and the cladding structure through the open bottom as indicated by the arrow 14 in FIG. 1. This bottom opening is achieved by the support feet 18 which dispose the bottom of the cladding structure above the floor as will be readily apparent in FIG. 1. A part of this air streams into the stove passing combustion air openings 18 in an ash door 15 of the stove situated below the fire door 3. The location of the fire door 3 and ash door 15 are indicated by broken lines in FIG. 1. The burning gases leave the stove 1 by an opening in the upper part of the rear wall, which may be connected to a chimney by a pipe 16.

The main part of the air is heated by streaming upward between the stove 1 and the cladding structure and comes out through the lattice means 12 of the top wall and the lattice means 13 of the side wall.

What is claimed is:

1. A stove for burning solid fuel comprising a combustion chamber in which said fuel is burned, said chamber having a front wall, along with a rear wall and two side walls arranged in a generally rectangular configuration, said front and rear walls each having a greater horizontal width than the horizontal width of said side walls, a cladding structure having a front wall along with a rear wall and two side walls arranged in a generally rectangular configuration, said walls of said cladding structure being spaced from the corresponding and respective walls of said chamber so as to define a space between said chamber and said cladding structure, said cladding structure and said chamber each having a top wall spaced from one another, said top wall of said cladding structure having air exit lattice means through which heated air exits from said stove, said stove having a bottom opening for introducing ambient air into said space between said chamber and said cladding structure such that said ambient air passes through said space between said chamber and cladding structure and is thereby heated before exiting from said air exit lattice means, said chamber having a fire door mounted on one of its side walls, said cladding structure having an access door mounted on one of its side walls, said fire door and access doors being generally aligned with one another to thereby provide access to said chamber for feeding fuel to said chamber, said one side wall of said cladding structure also having air exit openings at an upper portion thereof through which heated air exits from the stove, an inspection and viewing window in said front wall of said chamber and said front wall of said cladding structure, said window extending over the major portion of the breadth of said front walls of said chamber and cladding structure, whereby large logs may be fed into said chamber through said fire door in said chamber side wall while enabling use of a large window in said front wall of said chamber and cladding structure and thus affording good observation of the combustion process.

2. A stove according to claim 1 further comprising an ash door in said one side wall of said chamber, and means on said ash door for introducing combustion air into said chamber.

* * * * *